US007219521B1

(12) United States Patent
Eldredge

(10) Patent No.: US 7,219,521 B1
(45) Date of Patent: May 22, 2007

(54) ROLLING MILL PRODUCT HANDLING SYSTEM

(75) Inventor: Michael Eldredge, Harvard, MA (US)

(73) Assignee: Morgan Construction Company, Worcester, MA (US)

( * ) Notice: Subject to any disclaimer, the term of this patent is extended or adjusted under 35 U.S.C. 154(b) by 0 days.

(21) Appl. No.: 11/523,415

(22) Filed: Sep. 19, 2006

(51) Int. Cl.
*B21B 39/20* (2006.01)

(52) U.S. Cl. ..... 72/250; 72/201; 198/450; 414/745.7

(58) Field of Classification Search ..... 72/201, 72/250; 198/433, 450, 451, 452; 414/745.7
See application file for complete search history.

(56) References Cited

U.S. PATENT DOCUMENTS 2,809,545 A 10/1957 Norlindh
3,610,437 A * 10/1971 Barakov et al. ..... 414/745.7
3,621,696 A 11/1971 Norlindh
4,054,047 A 10/1977 Sclippa
4,307,594 A 12/1981 Steinbock
4,448,298 A 5/1984 Matsuo
4,905,816 A 3/1990 Matsuo et al.
5,301,794 A 4/1994 Tomasetig
6,192,729 B1 2/2001 Offoiach
6,855,290 B2 2/2005 Castellani

* cited by examiner

*Primary Examiner*—Dmitry Suhol
(74) *Attorney, Agent, or Firm*—Gauthier & Connors, LLP

(57) ABSTRACT

A product handling system comprises a support structure defining a pair of stationary inverted first channels with downwardly facing open sides. At least one cylindrical drum is interposed between each of the first channels and an underlying receiver. The drums are rotatable about their axes, with their surfaces arranged to close the open sides of the respective first channels. The drum surfaces are interrupted by second channels, with the first and second channels and the drum axes being arranged in a parallel relationship. Successive product lengths are alternately delivered longitudinally into one and then the other of the first channels. The drums are rotated about their axes resulting in the thus delivered product lengths being sequentially: (i) temporarily retained in the first channels by the rotating drum surfaces; (ii) deposited from the first channels into the second channels when the second channels rotate into radial alignment and communication with the first channels and (iii) downwardly deposited from the second channels to the receiver when the second channels rotate to discharge positions over the underlying receiver.

6 Claims, 4 Drawing Sheets

ROLLING MILL PRODUCT HANDLING SYSTEM

BACKGROUND

1. Field of the Invention

This invention relates generally to continuous hot rolling mills producing long products such as bars, rods, and the like, and is concerned in particular with an improved product handling system for longitudinally receiving subdivided lengths of such products as they issue from the rolling mill, and for transferring the product lengths to a receiver which typically will comprise a cooling bed.

2. Description of the Prior Art

In known product handling systems, such as for example those described in U.S. Pat. No. 3,621,696 (Norlindh) and U.S. Pat. No. 4,307,594 (Steinbock), successive product lengths are received in guide channels provided in the surfaces of rotatable drums. The drums are rotated, either continuously or intermittently, to deliver the thus received product lengths to underlying cooling beds.

Continuous drum rotation requires complicated upstream switching systems and mechanisms to reliably deliver the product lengths into the continuously moving guide channels. On the other hand, intermittent drum rotation requires heavy duty drives to overcome system inertia during the stop/start sequences, as well as precise controls to insure that the guide channels are stopped in proper alignment with the delivery path of the incoming product lengths.

The objective of the present invention is to provide a product handling system that in comparison to known prior art systems, is less complicated and easier to coordinate and control.

SUMMARY OF THE INVENTION

A product handling system in accordance with the present invention comprises a support structure defining a pair of stationary inverted first channels with downwardly facing open sides. At least one cylindrical drum is interposed between each of the first channels and an underlying receiver. The drums are rotatable about their axes, with their surfaces arranged to close the open sides of the respective first channels. The drum surfaces are interrupted by second channels, with the first and second channels and the drum axes being arranged in a parallel relationship. Successive product lengths are alternately delivered longitudinally into one and then the other of the first channels. The drums are rotated about their axes resulting in the thus delivered product lengths being sequentially: (i) temporarily retained in the first channels by the rotating drum surfaces; (ii) deposited from the first channels into the second channels when the second channels rotate into radial alignment and communication with the first channels and (iii) downwardly deposited from the second channels to the receiver when the second channels rotate to discharge positions over the underlying receiver.

These and other features and attendant advantages of the present invention will now be described in further detail with reference to the accompanying drawings, wherein:

DETAILED DESCRIPTION

Figure 1:
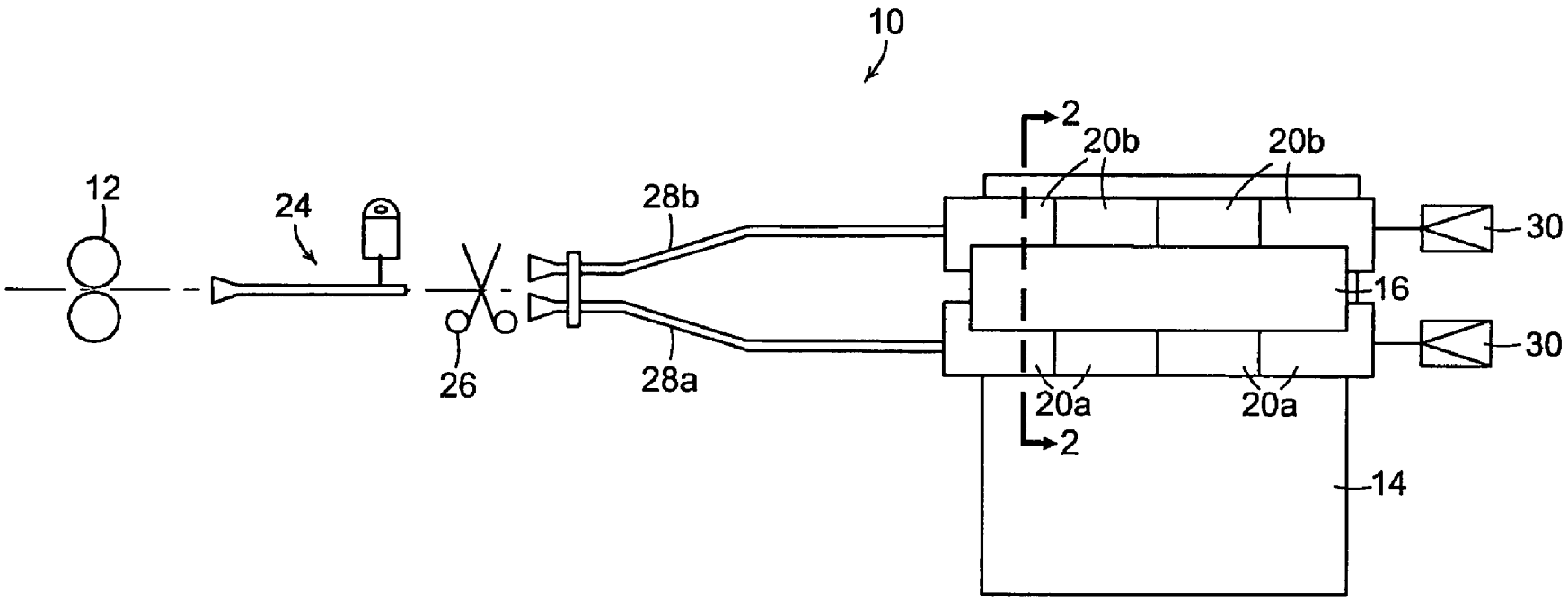
FIG. 1 is a schematic plan view of a product handling system in accordance with the present invention.
Figure 2:
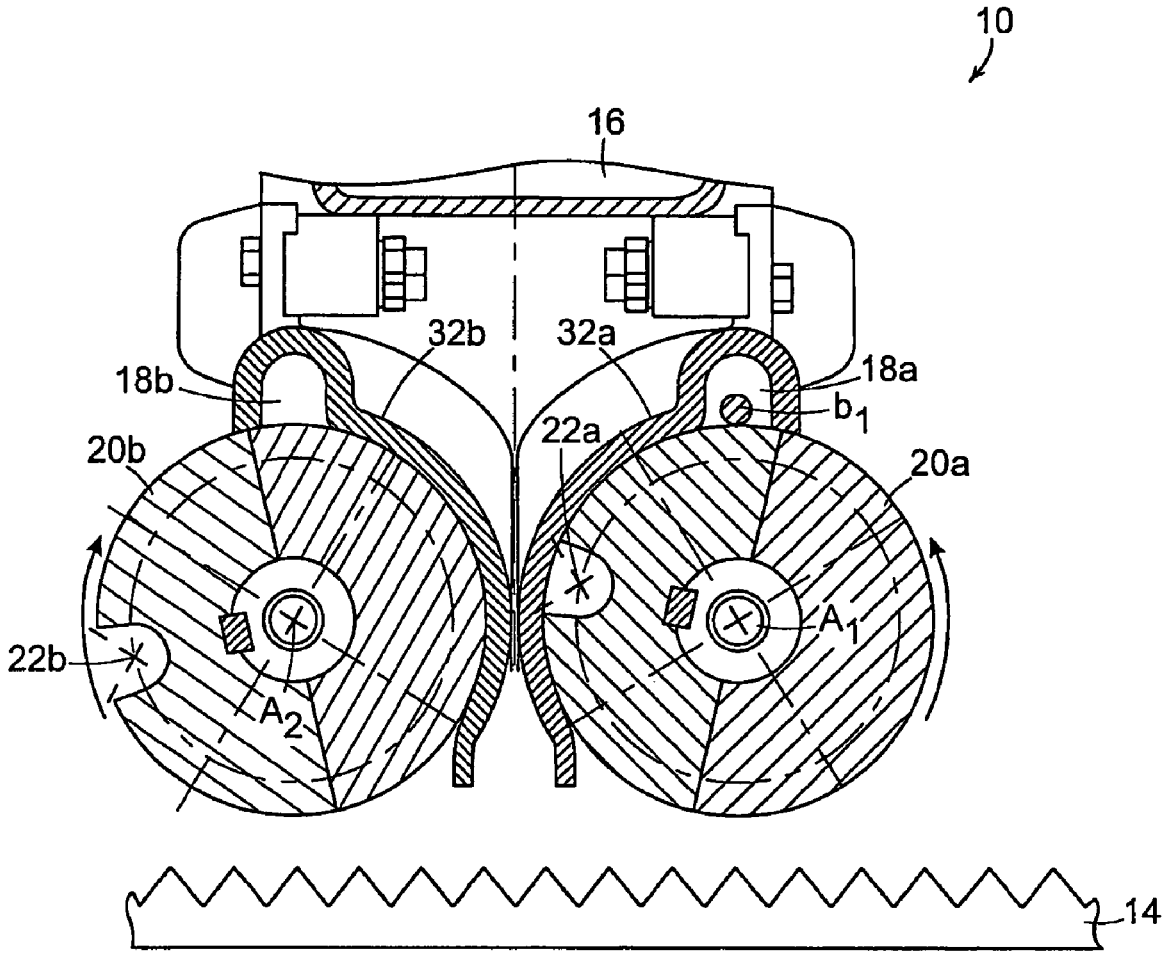
FIG. 2 is a sectional view on an enlarged scale taken along taken along line 2-2 of FIG. 1.

With reference initially to FIGS. 1 and 2, a product handling system in accordance with a preferred embodiment of the present invention is generally depicted at 10 between the last roll stand 12 of a rolling mill and a receiver comprising a conventional carryover cooling bed 14.

The system includes a support structure 16 defining a pair of inverted first channels 18*a*, 18*b* with downwardly facing open sides. Cylindrical drums 20*a*, 20*b* are interposed between each of the first channels 18*a*, 18*b* and the cooling bed 14. The drums are rotatable about their respective axes $A_1$, $A_2$ with the drum surfaces arranged to close the open sides of the respective first channels.

Each drum surface is interrupted by at least one second channel 22*a*, 22*b* with the first channels 18*a*, 18*b*, second channels 22*a*, 22*b* and drum axes $A_1$, $A_2$ arranged in parallel relationship.

Long products such as bars, rods and the like exiting from the last mill stand 12 are directed by a switch 24 to a shear 26 for subdivision into shorter product lengths. The switch and shear act in concert in a known manner to alternatively direct the subdivided product lengths to one and then the other of a pair of guide pipes 28*a*, 28*b* having delivery ends aligned respectively with the first guide channels 18*a*, 18*b*.

As can be best seen in FIG. 1, a plurality of the first and second drums 20*a*, 20*b* are aligned axially in series between each of the first channels 18*a*, 18*b* and the cooling bed. Drive motors 30 serve to rotate the drums of each series.

The drums may be rotated intermittently, but most preferable are rotated continuously, with the drums of one series being rotated in a direction opposite to that of the other series.

At the operational stage depicted in FIG. 2, a first bar $b_1$ has been delivered to the first channel 18*a* via guide pipe. The first channel is closed by the rotating surface of drum 20*a*. The first bar is thus temporarily retained in the first channel while the other rotating first channel 22*b* remains empty as it approached the empty first channel 18*b*. Drum 20*a* is rotating in a counter clockwise direction, and drum 20*b* is rotating in a clockwise direction.

Figure 3A:
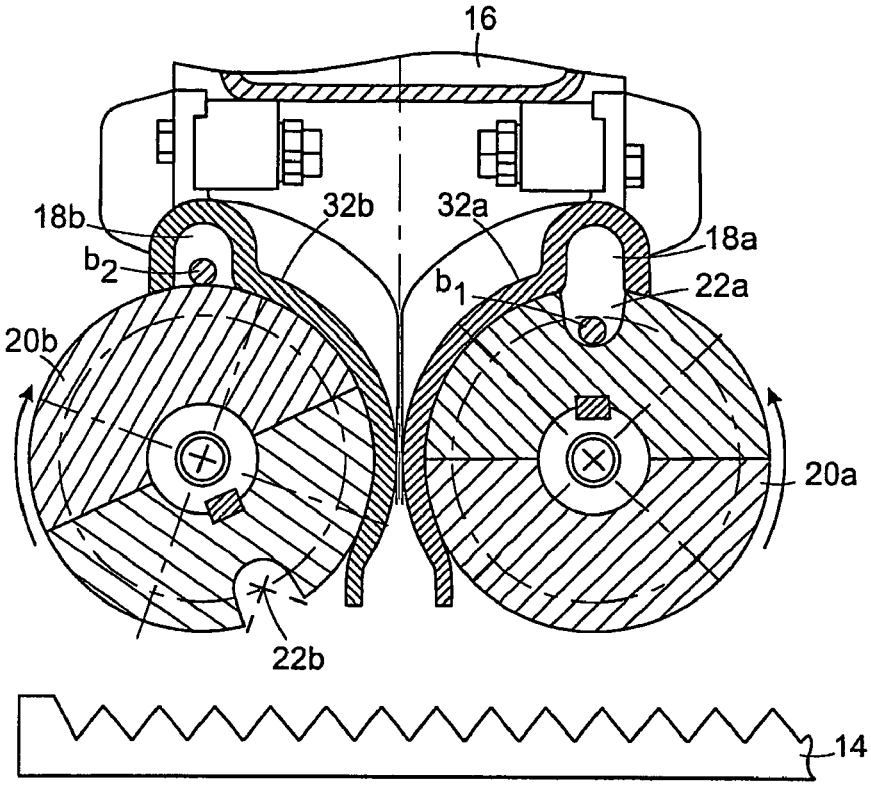
FIGS. 3A to 3C are views similar to FIG. 2 depicting sequential stages in the handling of products received from the rolling mill.

At the stage depicted in FIG. 3A, the second channel 22*a* has rotated into radial alignment and communication with first channel 18*a*, allowing the first bar $b_1$ to be deposited in the second channel. The second channel 22*b* has rotated past the first channel 18*b*, which has now received a second bar $b_2$.

Figure 3B:
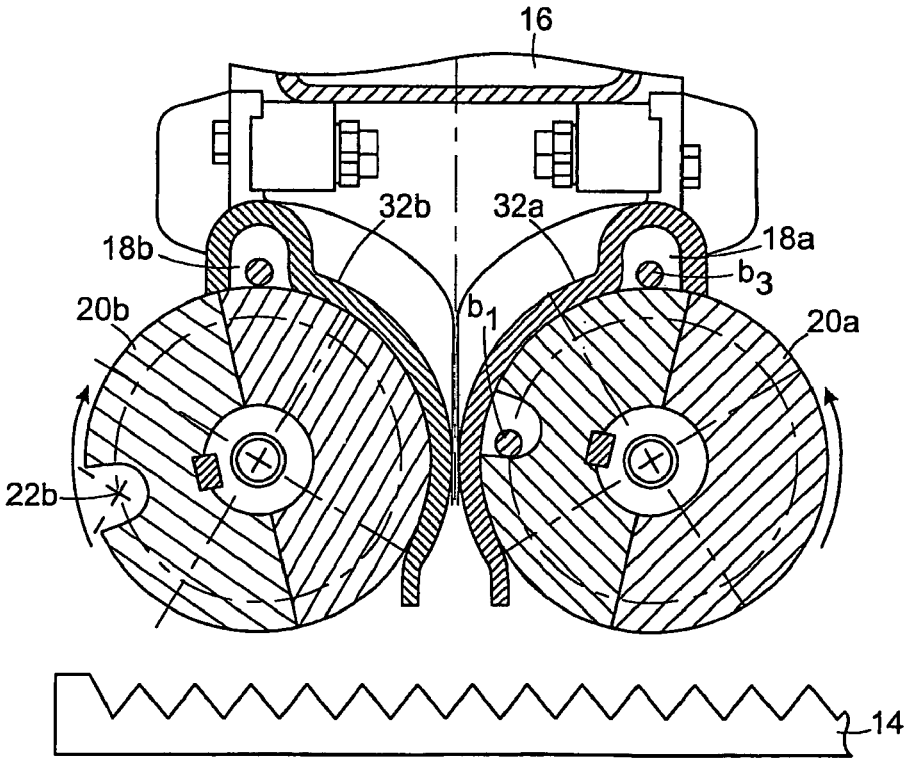

At the stage shown in FIG. 3B, the second channel 22*a* containing the first bar $b_1$ has now rotated out of alignment with first channel 18*a*, the latter again having again been closed by the drum surface and filled with a third bar $b_3$.

Figure 3C:
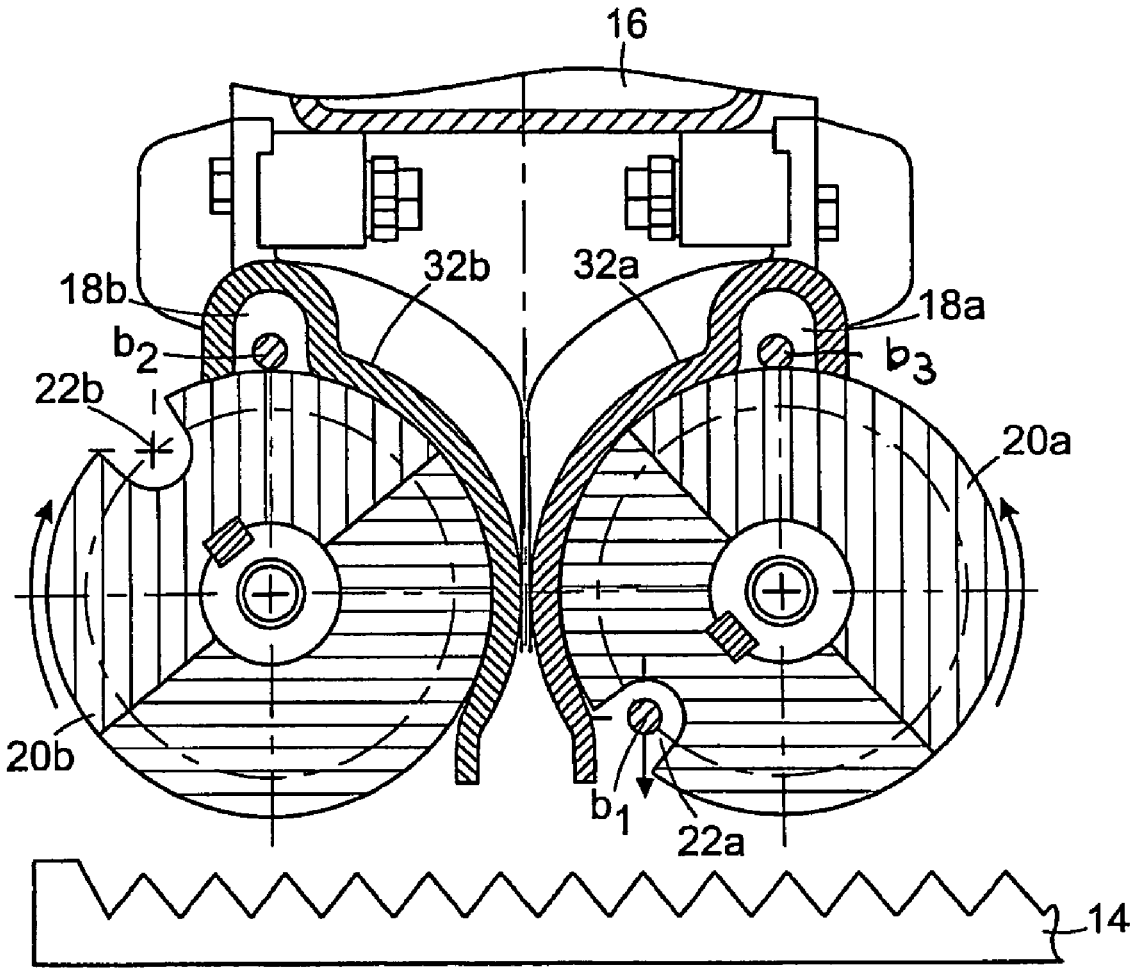

At the stage shown in FIG. 3C, the second channel 22*a* has rotated to a discharge position, allowing the first bar $b_1$ to be transferred downwardly to the cooling bed 14. The second channel 22*b* of drum 20*b* is approaching the first notch 18*b*, where it will pick up the second bar $b_2$ for delivery to the cooling bed as it continues to rotate to its discharge position. These sequences will be repeated to handle successively delivered product lengths.

The support structure 16 preferable includes shrouds 32*a*, 32*b* that partially envelop the drum circumferences from the first channels 18*a*, 18*b* to the respective discharge positions.

In light of the foregoing, it will be understood by those skilled in the art that various modifications of the above described system may be made without departing from the inventive concept defined by the appended claims. Non limiting examples of such modifications include, for example, the use of more than two parallel first channels acting in concert with the same number of drum series. Receivers other than cooling beds may serve to gather and/or transport product lengths being discharged from the respective second channels. Also, the drum surfaces may be provided with additional second channels.

I claim:

1. A product handling system for longitudinally receiving product lengths from a rolling mill, and for transferring said product lengths to an underlying receiver, said system comprising:

a support structure defining a pair of stationary inverted first channels with downwardly facing open sides;

at least one cylindrical drum interposed between each of said first channels and said receiver, said drums being rotatable about their axes and having drum surfaces arranged to close the open sides of the respective first channels, said drum surfaces being interrupted by second channels, with said first and second channels and drum axes being arranged in a parallel relationship;

delivery means for alternately delivering sequential product lengths longitudinally into one and then the other of said first channels; and drive means for rotating said drums, the arrangement of said drum surfaces and said second channels relative to said first channels being such that as a result of drum rotation, the thus delivered product lengths are each sequentially:

(i) temporarily retained in said first channels by the rotating drum surfaces;

(ii) deposited from said first channels into said second channels when said second channels are rotated into radial alignment and communication with said first channels; and (iii) downwardly transferred from said second channels to said receiver when said second channels are rotated to a discharge positions over said receiver.

2. The system of claim 1 wherein a series of said drums are interposed between each of said first channels and said receiver, the drums of each series being aligned on a common axis with their respective second channels in alignment, and wherein said drive means operates to rotate the drums of each series in unison.

3. The system of claim 1 or 2 wherein said drive means operates to rotate said drums continuously.

4. The system of claim 1 wherein said support structure additionally defines shrouds partially enveloping said drums and extending circumferentially from said first channels to said discharge positions.

5. The system of claim 1 wherein said drive means is operative to rotate said drums in opposite directions.

6. A product handling system for longitudinally receiving subdivided product lengths from a rolling mill, and for transferring said product lengths to an underlying receiver, said system comprising:

a support structure defining a pair of stationary inverted first channels with downwardly facing open sides;

a series of cylindrical drums interposed between each of said first channels and said receiver, the drums of each series being rotatable in unison about a common axis and having drum surfaces arranged to close the open sides of the respective first channels, the drum surfaces of each series being interrupted by aligned second channels, with said first channels, said aligned second channels and said axes being arranged in a parallel relationship;

delivery means for alternately delivering sequential product lengths longitudinally into one and then the other of said first channels; and drive means for continuously rotating the drums of each of said series in opposite directions, the arrangement of said drum surfaces and their second channels relative to the respective first channels being such that as a result of the rotation of said drums, the thus delivered product lengths are each sequentially:

(i) temporarily retained in said first channels by the rotating drum surfaces;

(ii) deposited from said first channels into said aligned second channels when said second channels are rotated into radial alignment and communication with said first channels; and (iii) downwardly transferred from said second channels to said receiver when said second channels are rotated to discharge positions over said receiver.

* * * * *